United States Patent [19]

Schuld

[11] Patent Number: 4,526,288

[45] Date of Patent: Jul. 2, 1985

[54] REMOTE CONTROLLED COVER AND MOUNTING MEANS THEREFORE

[76] Inventor: Leo A. Schuld, P.O. Box 1685, Wausau, Wis. 54401

[21] Appl. No.: 410,967

[22] Filed: Aug. 24, 1982

[51] Int. Cl.[3] ..... B65D 43/26

[52] U.S. Cl. ..... 220/264; 220/263; 220/329

[58] Field of Search ..... 220/264, 366, 260, 263, 220/329

[56] References Cited

U.S. PATENT DOCUMENTS

| | | | |
|---|---|---|---|
| 1,470,910 | 10/1923 | Banes | 220/264 |
| 2,195,132 | 3/1940 | Nelson | 220/367 |
| 2,325,897 | 8/1943 | Waltman | 220/264 |
| 2,827,003 | 3/1958 | Stetson | 220/264 |
| 3,389,826 | 6/1968 | Wall | 220/264 |
| 4,038,720 | 8/1977 | Zulop | 220/264 |
| 4,227,414 | 10/1980 | Elkins | 220/264 |

FOREIGN PATENT DOCUMENTS

| | | | |
|---|---|---|---|
| 146377 | 11/1903 | Fed. Rep. of Germany | 220/264 |
| 1175565 | 8/1964 | Fed. Rep. of Germany | 220/260 |
| 1121167 | 7/1956 | France | 220/260 |

*Primary Examiner*—Joseph Man-Fu Moy

*Attorney, Agent, or Firm*—John S. Roberts, Jr.

[57] ABSTRACT

A remotely controlled cover means for a storage bin or the like, comprised of a cover which may be opened from a remote location by means of a rope or the like attached to said cover and guidance means therefore. The pulling force exerted by the rope causes the cover to pivot up from the storage bin access opening, outwardly and downwardly by means of an offset angled pivot means. A spring latch device is employed to return the cover to the closed or spaced vented position when desired.

2 Claims, 5 Drawing Figures

REMOTE CONTROLLED COVER AND MOUNTING MEANS THEREFORE

BACKGROUND OF THE INVENTION

The prior art teaches various remote controlled cover means adapted for use in conjunction with large containers with access openings, for example, bulk feed tanks with openings in which access is difficult. These covers, and their various means of operation are found in U.S. Pat. Nos. 1,244,220; 1,486,439; 2,137,483; 2,271,411; and 4,267,936. These patents typify the general state of the art in this area. The present invention is distinguished by its adaptability, simplicity of operation, economy of movement and parts and its innovative application of fundamental concepts which have not heretofore been subject to such concerted and simplified application.

SUMMARY OF THE INVENTION

The present invention relates to a remote controlled cover and mounting means for bulk feed tanks or the like, which can be mounted and used in an economical, simple and efficient manner. In essence, the cover and means of remote control, is comprised of a lid which can be opened from a remote location by means of a rope which is secured to an offset angled pivot means and runs through a series of guidance means to the operator. The pulling force exerted on the rope causes the lid or cover to at once pivot upwardly and outwardly from the access opening and then downwardly in accordance with the slope of the offset angled pivot means. The angle of the cover minimizes resistance and thereby permits its removal in a most efficient manner. A spring latch device (utilizing a rope means with guidance means) returns the cover to the closed position. In addition, the device is capable of positioning by means of a spacing arrangement to permit the cover to be housed alternatively in a spaced vented position or a completely closed manner.

PREFERRED EMBODIMENT OF THE INVENTION

Figure 1:
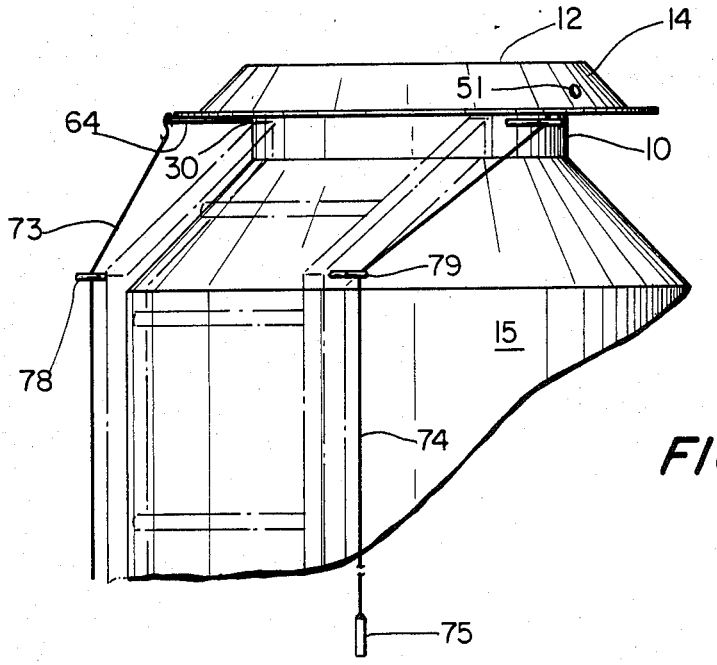
FIG. 1 is a perspective view of a bulk feed tank with the present invention mounted thereon.

The remote controlled cover of the present invention is seen in FIG. 1 and is designated generally by the numeral 10 and is comprised of a cover apparatus 12 secured to the access opening 13 at a point located on an annular rim 20, by means of an offset angle pivot means 30, shown in greater detail in FIGS. 2–5.

The cover 12 is sloped radially downward 14 so that its entire circumference facilitates the cover's movement 80 outward and downward from the access opening. An annular groove 51 is placed near the outer circumference of the cover 12 at a point diametrically opposite the point at which the cover 12 is secured to the angle pivot means 30. The cover 12 can be secured to the pivot means by using bolts 31 or similar suitable fastening means which can be secured through annular openings 33 in the cover 12 and an angled plate 34 which can be secured to the angular pivot 30 by weld 35 or other suitable method.

Figure 5:
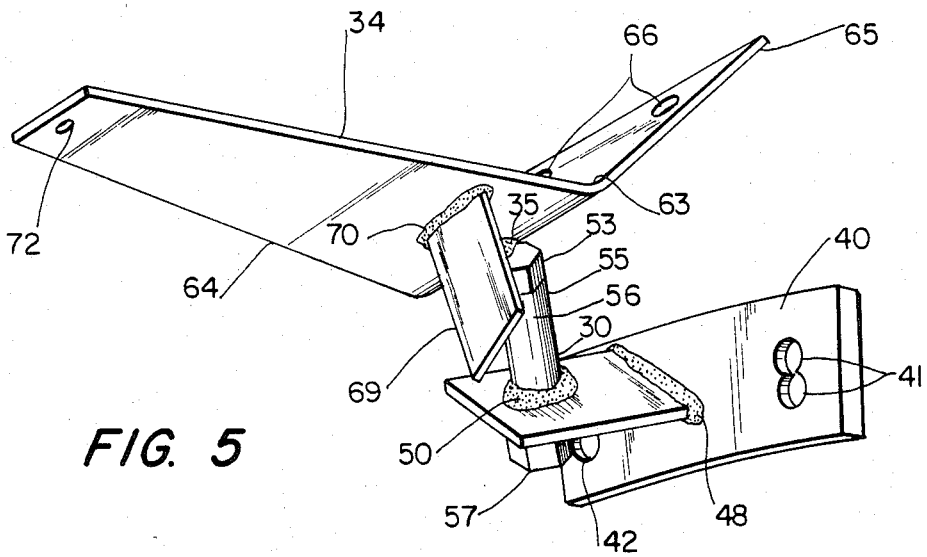
FIG. 5 is a detailed view of offset angle pivot means.

With reference to FIG. 5, the angular pivot means 30 is composed of a rectangular base plate of metal 40, or other suitable material, which is shaped to conform to the circumference of an annular rim 20, which circumference forms the access opening 13 to a storage bin generally designated as 15 in FIG. 1—the preferred embodiment used herein. The rectangular base plate 40 is fitted with longitudinal slots 41 and 42 which correspond to holes in the annular rim. The base plate 40 is secured to the annular rim 20 by means of bolts 43 or other suitable fastening means. The slots 41 and 42 can permit the adjustment of the cover 12 in its closed position, to permit a spaced vented position as in FIG. 2. The base plate 40 is secured to a rectangular metal plate 50 which extends radially from the base plate 40 at an angle 48 which will facilitate the opening and closing of the cover 12. The plate is fitted with an annular groove 52 through which can be secured a bolt type or other suitable pivot means 55. In this embodiment, the pivot is composed of an annular tube 56 which is secured to align with the groove 52 on the plate 50. A bolt type means 53 can be inserted through the tube 56 and groove 52 and is secured by a nut 57 or other friction means. The pivot means is further secured to a rectangular brace plate 34 made of metallic or other suitable material. The brace plate 34 is disposed to form an angular configuration. The pivot means 55 is joined to the brace plate 34 by a single weld 35 or other suitable means. The apex of the angular base plate 63 is at a point approximately ⅓ from the end of said plate which shows two distinct mated flanges 64 and 65, one 64 extending approximately two times as far from the apex 63 as the other 65. The entire brace plate 34 can be pre-formed from a single casting or from two distinct rectangular plates joined at a proper angle by weld or other appropriate means. The shorter of the flanges 65 is fitted with three or more annular grooves 66 which facilitate attachment with the cover 12 by means of mated grooves 67 in said cover. The cover 12 and flange 65 can be secured by bolts or other suitable friction means. The larger flange 64 is fitted with a trapazoidal plate member 69 by weld 70 or other suitable means. The trapazoidal plate member 69 is placed at a right angle to the flange 64 and acts as a friction break to hold the cover 12 when in the open position, FIG. 3. At the end of the flange 64 is an annular groove 72 to facilitate the attachment of a rope, cord 73 (FIG. 1) or other suitable means for operation of the cover 12 from a remote location, FIG. 1. The cord 73 extends from the flange 64 through a series of eye bolts 78 to a place where the cover can be opened by the exertion of downward pressure supplied by the operator.

The cover can be closed by means of a weighted spring latch device 75, FIG. 1, which is attached to the cover 12 by means of a rope, cord 74 or other suitable means at the annular groove 51 located in the cover 12. The rope 74 is run through a series of eye bolts or other suitable guidance means 79 to a place where the cover can be closed by exertion of downward pressure supplied by the operator.

Figure 2:
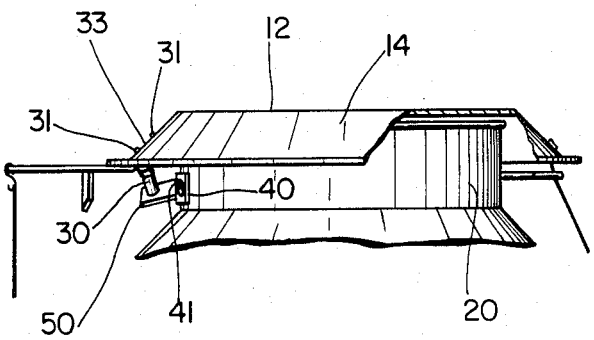
FIG. 2 is a perspective view showing the cover mounted in a closed position with positioning of offset angle pivot means.
Figure 3:
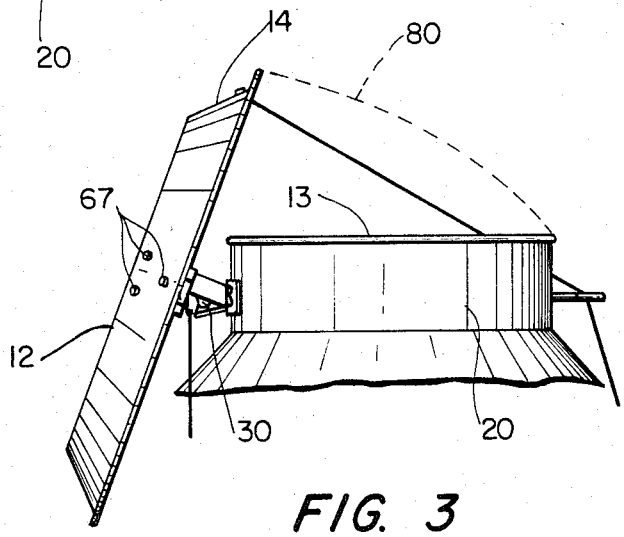
FIG. 3 is a perspective view showing the cover mounted in a fully opened position with view of mounted pivot means.
Figure 4:
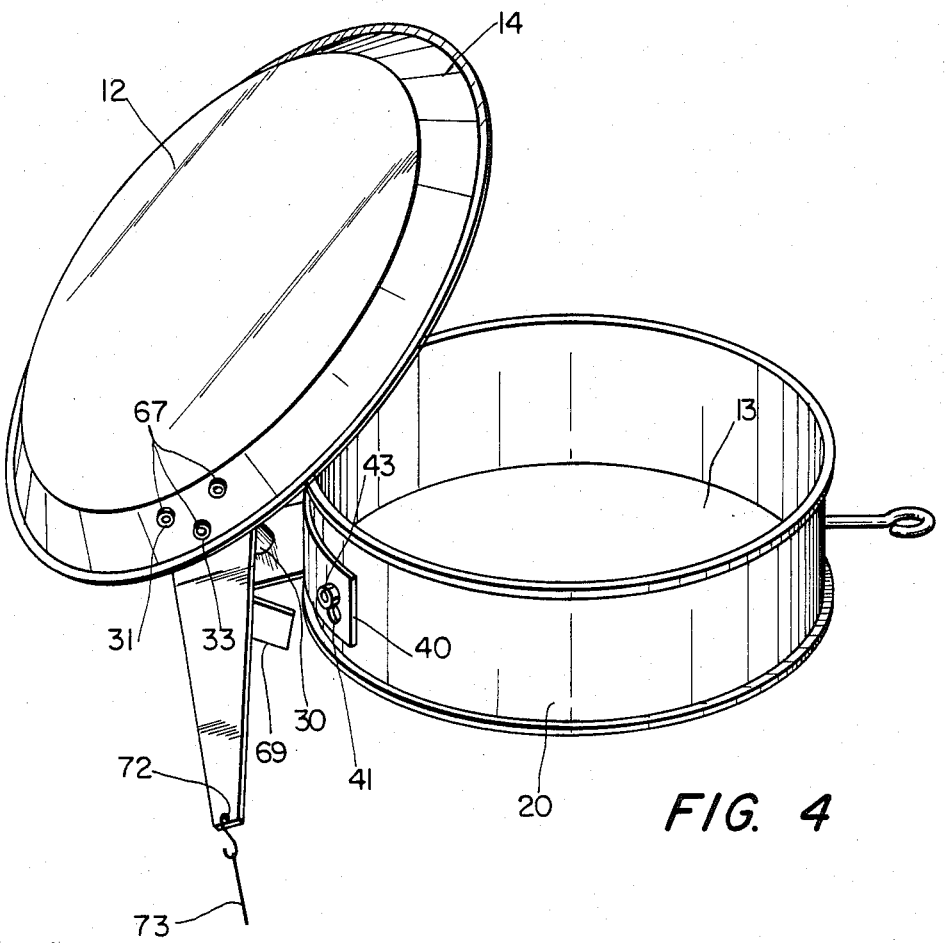
FIG. 4 is a detailed view of the offset angle pivot means secured to opening rim.

The cover 12 can be adjusted to close in the space vented position, FIG. 2, by a simple adjustment of the angular pivot means 30 on the annular rim 20 by moving the rectangular base plate member 40 upwardly on the rim 20 and securing bolts 43 through the slots on the rim 20 and the lower portion of the longitudinal slots 41 and 42 on the base plate 40.

I claim:

1. An offset angled pivot means of a cover for a bulk storage tank with remote controlles support therefor comprising additionally a cover member, a cord member with guidance means to remotely operate said cover, a spring latch means for returning said cover to a closed position, a spacing arrangement to permit said cover to be placed in a space vented position, wherein the pivot means is secured to a brace plate which is disposed to form an angular configuration; the movement of said plate by means of the pivot member facilitates removal and replacement of the cover by remote control in an efficient manner.

2. The remote controlled support means of a cover for a bulk storage tank comprising additionally a cover member, an offset angled pivot means, a cord member with guidance means to remotely operate said cover, a spring latch means for returning said cover to a closed position, a spacing arrangement to permit said cover to be placed in a space vented position, whereby removal and replacement of the cover member is performed, consisting of at least one rope or cord, attached to the offset angled pivot means and extending to the remote location by use of guidance means.

* * * * *